United States Patent [19]

Weaver et al.

[11] Patent Number: 4,488,412

[45] Date of Patent: Dec. 18, 1984

[54] ADJUSTABLE AIR DUCT FOR A MEAT KEEPER

[75] Inventors: Douglas E. Weaver, Greenville; Ralph W. Brown, II, Orleans, both of Mich.

[73] Assignee: White Consolidated Industries, Inc., Cleveland, Ohio

[21] Appl. No.: 551,335

[22] Filed: Nov. 14, 1983

[51] Int. Cl.[3] ..... F25D 25/02

[52] U.S. Cl. ..... 62/382; 62/408; 62/441

[58] Field of Search ..... 62/78, 382, 337, 408, 62/441

[56] References Cited

U.S. PATENT DOCUMENTS

| | | | |
|---|---|---|---|
| 1,935,647 | 11/1933 | Madden | 62/408 X |
| 2,382,084 | 8/1945 | Mathews | 62/408 X |
| 2,494,024 | 1/1950 | Williams | 62/78 X |
| 3,364,694 | 1/1968 | Cohen et al. | 62/408 |
| 3,377,941 | 4/1968 | Jaremus | 62/441 X |
| 3,473,345 | 10/1969 | Pfeiffer et al. | 62/408 |
| 3,575,011 | 4/1971 | Dill et al. | 62/408 |
| 3,638,717 | 2/1972 | Harbour et al. | 62/382 X |

*Primary Examiner*—Lloyd L. King

*Attorney, Agent, or Firm*—Pearne, Gordon, Sessions, McCoy, Granger & Tilberry

[57] ABSTRACT

A meat keeper compartment includes an adjustable air duct assembly which supplies cold air flow from the evaporator compartment of a top freezer type refrigerator into a meat keeper receptacle slidably mounted on a shelf which may be positioned at different levels or on different sides of the fresh food compartment of the refrigerator. The air duct assembly consists of an air deflector which receives cold air from the freezer through a slot in the partition between the freezer and fresh food compartment, a cold air outlet to deliver cold air into the meat keeper receptacle, an upper air duct having the back wall of the refrigerator form the back wall of the duct, a lower air duct which telescopes with the upper air duct for adjustment of the cold air outlet, and an adjustable air damper for regulation of the amount of cold air flow.

12 Claims, 11 Drawing Figures

ADJUSTABLE AIR DUCT FOR A MEAT KEEPER

BACKGROUND OF THE INVENTION

This invention generally relates to household refrigerators and more particularly concerns an adjustable air duct to supply cold air flow from the evaporator compartment of the refrigerator into a meat keeper which may be positioned at different levels or on different sides of the fresh food compartment of a top freezer refrigerator.

The ideal temperature for storing fresh meat is 33° or just above freezing. This temperature, however, is below the preferable temperature for storing other perishable items such as vegetables, fruits and dairy products. The normal temperature of a fresh food compartment within the refrigerator is 36°-38° F. It is therefore recognized that if a separate compartment is provided for meat within the fresh food compartment, and is kept at a colder temperature, fresh meat will keep longer.

In order that the meat compartment be at a lower temperature, it is often located at the bottom of the fresh food compartment. This design relies on the fact that colder air flows down the back of the refrigerator and tends to collect in the bottom of the fresh food compartment. Thus the colder air chills the meat compartment.

A problem with this arrangement is the inconvenience to the user of a meat keeper compartment which is located at the bottom of the refrigerator. The user is forced to constantly stoop to put meat into the compartment or to take it out.

For the sake of convenience for the user, it is preferable to mount the meat keeper compartment directly below the top shelf in the fresh food compartment of the refrigerator. At this location it is easy to place even heavy roasts into the compartment and easy as well to see into the back of the compartment so that food does not become lost in the back of the compartment.

In order to provide colder air flow at the top shelf location, previous designs have required that the top shelf be substantially immovable.

The meat keeper compartment generally occupies only half the width of the fresh food compartment. Previous designs have thus also required that the meat compartment be fixed to one side of the refrigerator. This prohibited the option of switching sides.

It is of great advantage to the user to be able to shift the meat keeper compartment vertically to allow various spacing within the fresh food compartment. It is also an advantage to be able to locate the meat keeper compartment on either side of the refrigerator, especially for refrigerators in which the door may be hinged from either side. The meat keeper should be easily adjustable to allow maximum convenience for the user.

It is also an advantage to the user to provide an air flow control so that the user may determine for himself how cold to keep the meat keeper compartment in relation to the fresh food compartment. The control should be easy to manipulate and permit the user to provide a ready adjustment in the cold air flow so that the user can compensate for type or amount of meat or provide less cold air flow when the user wants to slowly defrost frozen meat by storing it in the meat keeper compartment.

SUMMARY OF THE INVENTION

In accordance with the present invention, an adjustable air duct is provided for a meat keeper compartment in a top freezer type refrigerator. In this type of refrigerator the freezer compartment is separated from the fresh food compartment by an insulated partition. An evaporator compartment containing the evaporator coils is located behind another partition which is located within the freezer compartment.

The present invention provides an air deflector mounted on the bottom side of the insulated partition separating the evaporator compartment of the freezer area and the fresh food compartment of a refrigerator. A vent in this partition allows the flow of cold air from the freezer into the air deflector.

A duct cooperates with the deflector to channel cold air into a meat keeper mounted within the fresh food compartment. The deflector is provided as well with openings that allow cool air from the freezer to be channeled directly into the fresh food compartment.

Within the duct, there is a damper to control the amount of air which flows through the duct into the meat keeper.

The duct is mounted on the back of the fresh food compartment and can be inserted in either the left side or the right side of the deflector. This allows the owner of the refrigerator to place the meat keeper duct on either the left side or the right side of the refrigerator.

The duct has an upper and lower member which telescope against the back of the refrigerator, the back wall of the refrigerator forming part of the duct. This enables the owner to adjust the height of the duct and thereby the position of the meat keeper.

DESCRIPTION OF THE PREFERRED EMBODIMENT

Figure 1:
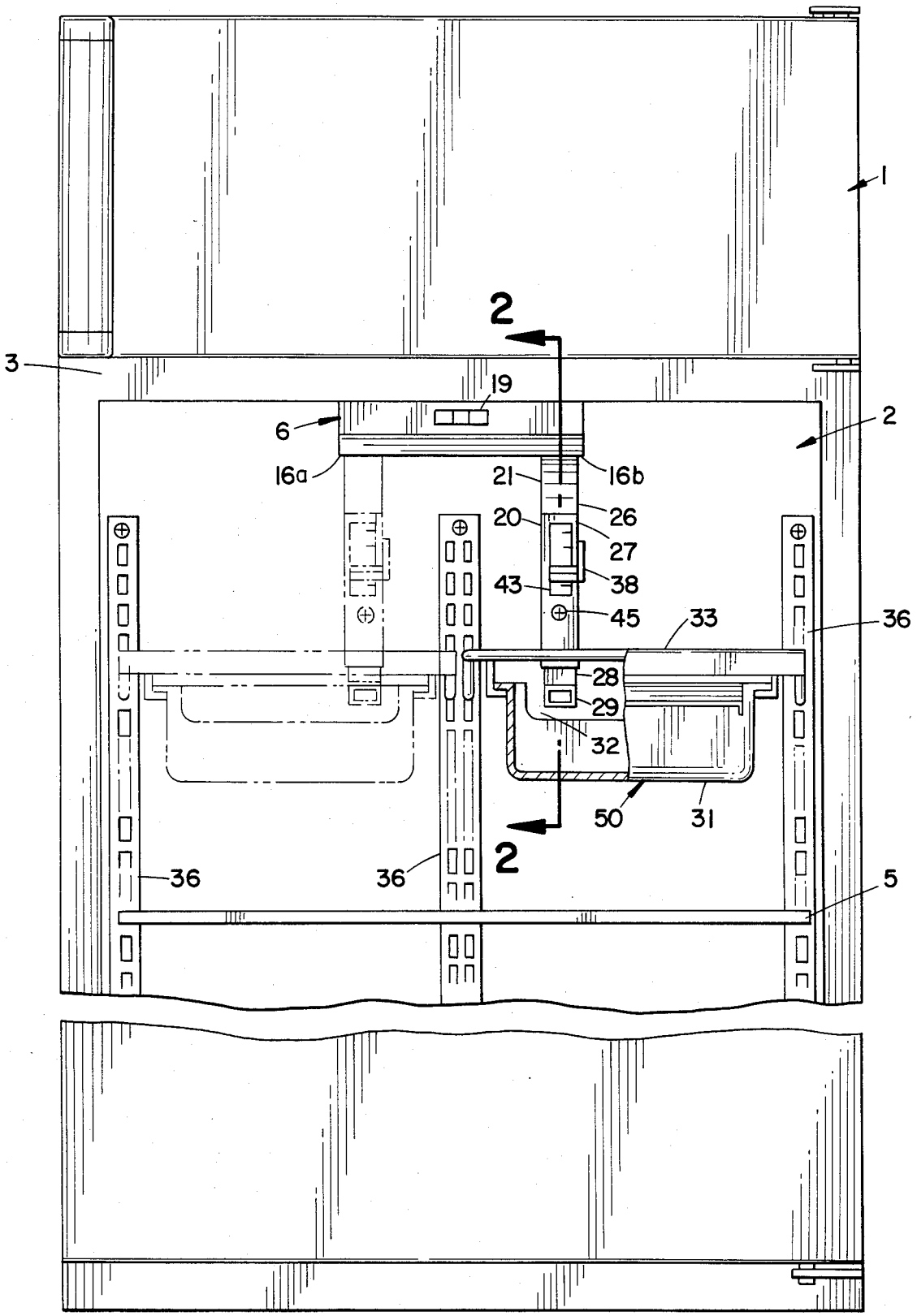
FIG. 1 is a front view of the refrigerator showing the air duct in accordance with the present invention and showing a second position for the meat keeper and meat keeper duct in phantom.

The illustrated refrigerator freezer is one of the top freezer variety in which the cabinet is divided by a partition assembly 3 into an upper freezer compartment 1 and a lower fresh food compartment 2. An evaporator compartment 15 which contains the evaporator coils (not shown) is located behind a partition 15*a* within the freezer compartment 1 in the top section of the refrigerator.

The fresh food compartment 2 is provided with a meat keeper compartment 50 accessible by sliding out the meat keeper receptacle 31 which is suspended on rails secured to a meat keeper cover shelf 33.

Food storage shelves such as shelf 5 are also provided. These shelves are mounted by means of shelf supports 36 and can be placed at various levels within the refrigerator. Similarly, the cantilevered meat keeper cover shelf 33 is also mounted on shelf supports 36 and can be placed at various levels of the refrigerator.

The meat keeper cover shelf 33 can be mounted from the shelf supports 36 on either the right side or the left side of the fresh food compartment 2. This permits flexibility in determining how to organize the storage space within the fresh food compartment 2 to most efficiently suit individual needs. Being able to shift the meat keeper compartment 50 laterally to either the left side or the right side of the fresh food compartment 2 is a particular advantage for refrigerators in which the door may be hinged from either the left side or the right side of the refrigerator.

Figure 2:
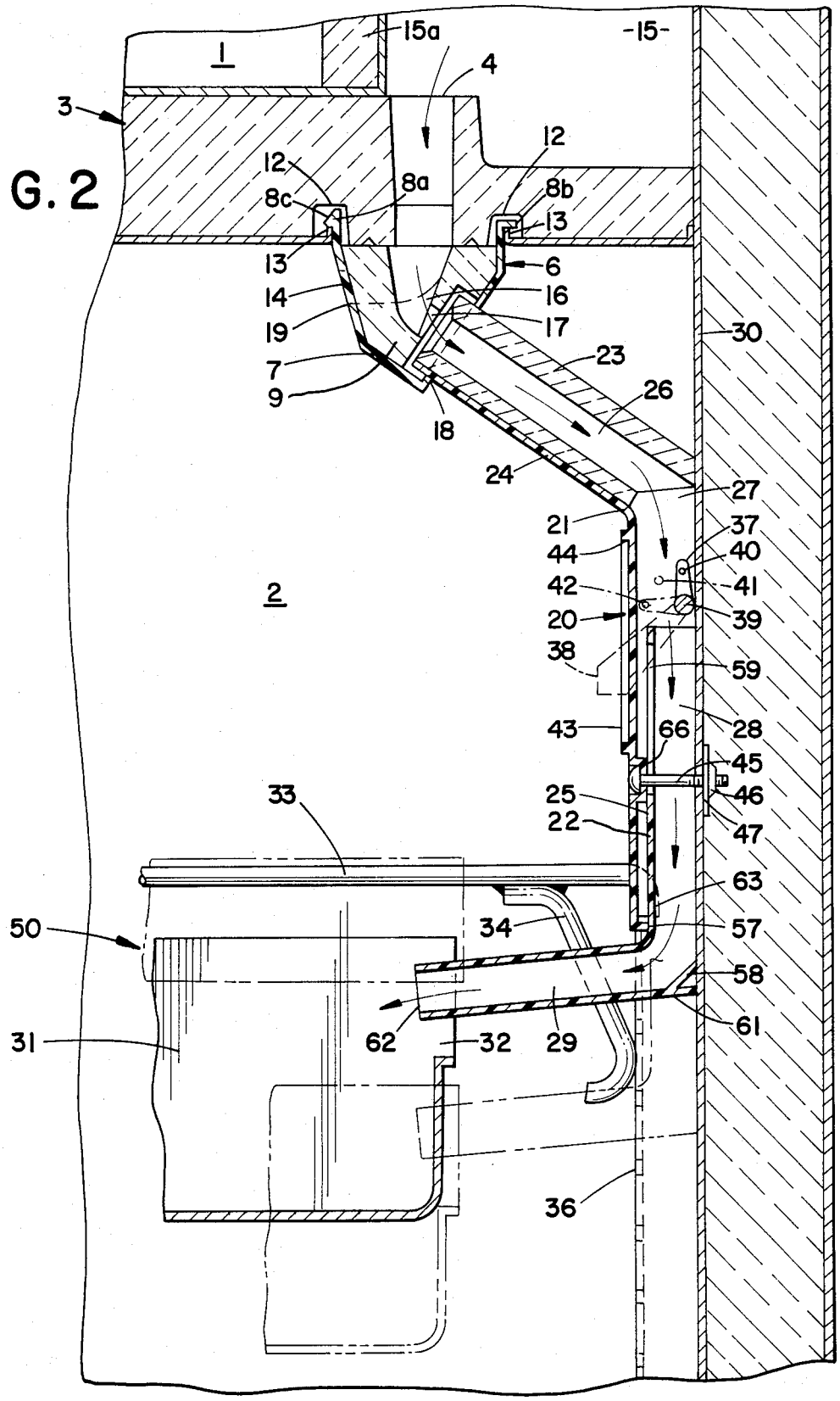
FIG. 2 is a cross-sectional view of the refrigerator taken on line 2—2 of FIG. 1.
Figures 3, 11:
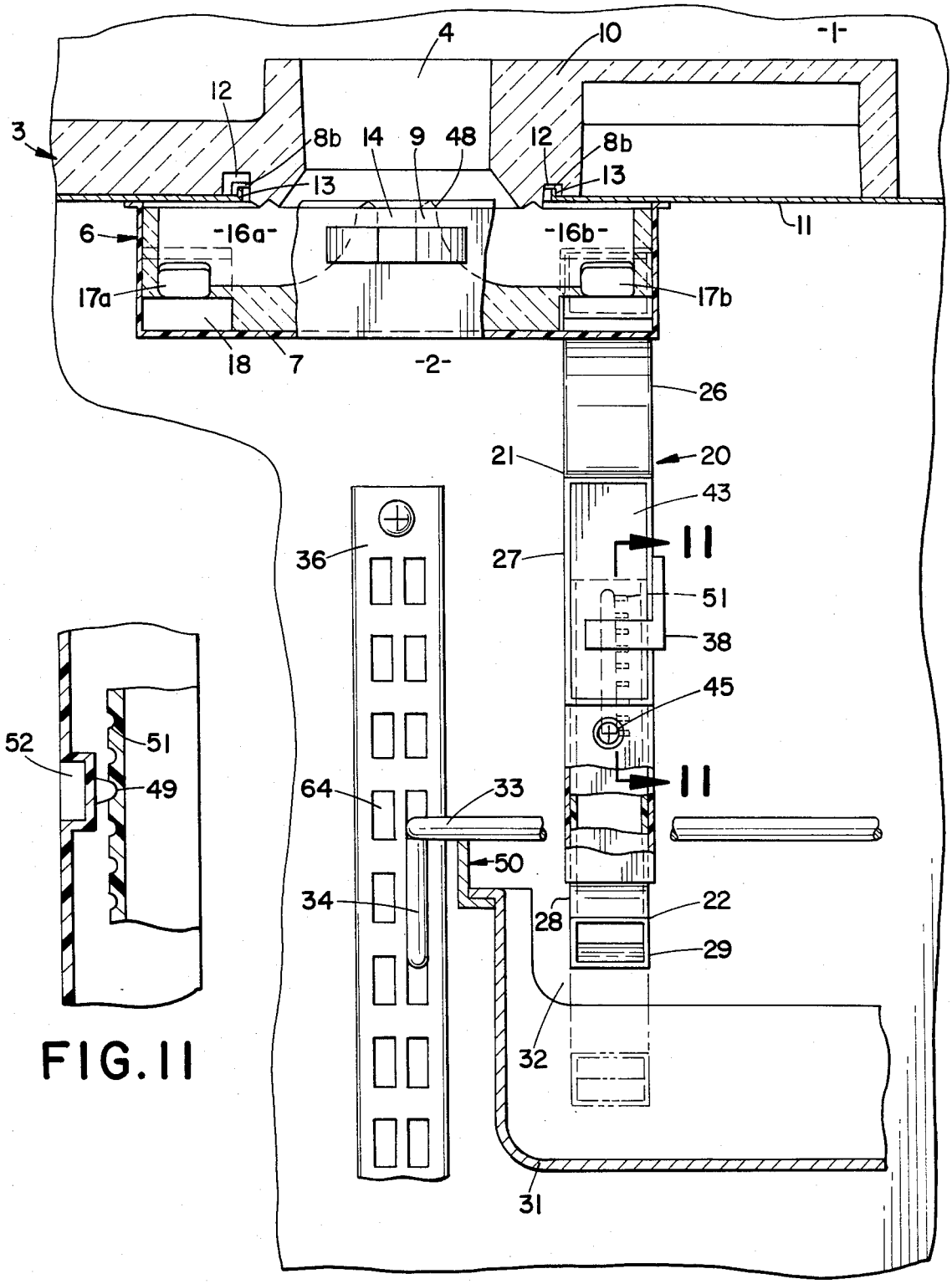
FIG. 3 is an enlarged front elevational view, partly in section, of the air duct shown in FIG. 1.
FIG. 11 is a fragmentary sectional view in detail of the detaining means within the upper and lower air duct members.
Figure 4:
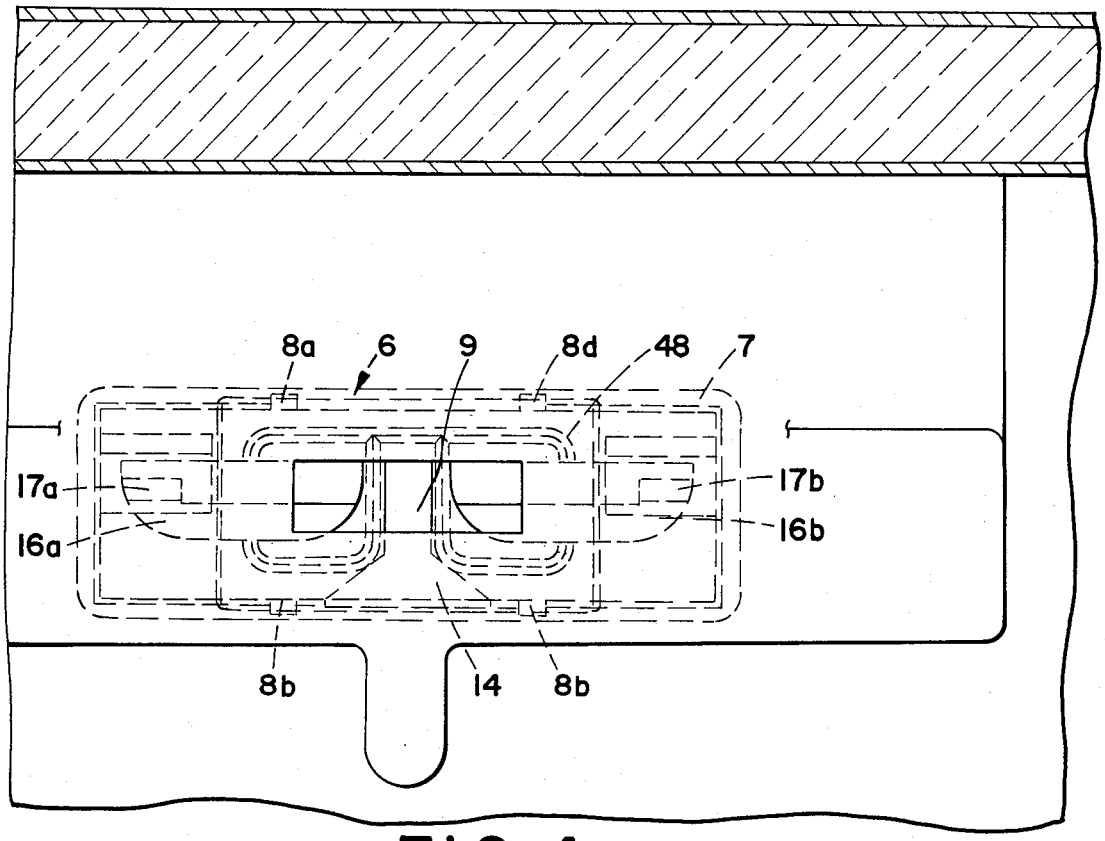
FIG. 4 is a top plan view of the air deflector and air deflector cover in place in the freezer.
Figure 5:
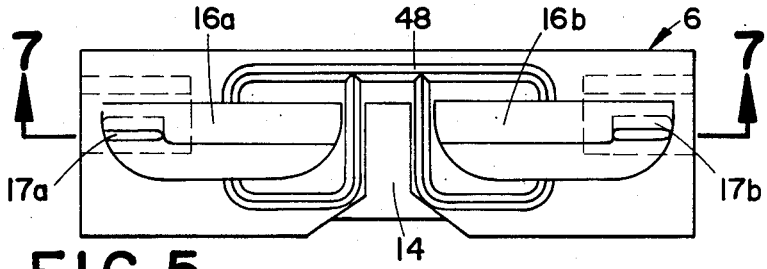
FIG. 5 is a top plan view of the air deflector.
Figure 8:
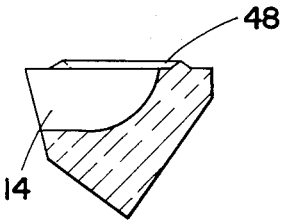
FIG. 8 is a cross-sectional view of the air deflector taken on line 8—8 of FIG. 6.
Figure 6:
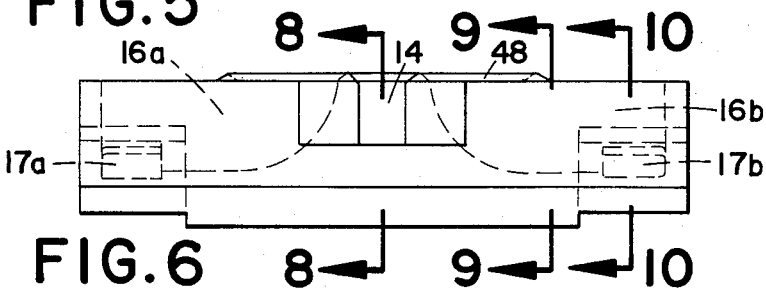
FIG. 6 is a front elevational view of the air deflector.
Figure 9:
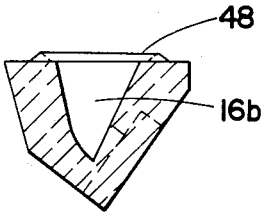
FIG. 9 is a cross-sectional view of the air deflector taken on line 9—9 of FIG. 6.
Figure 7:
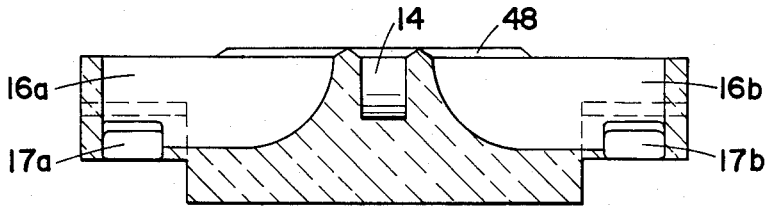
FIG. 7 is a cross-sectional view of the air deflector taken on line 7—7 of FIG. 5.
Figure 10:
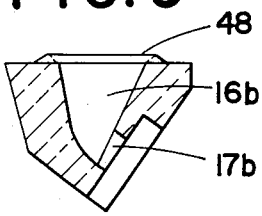
FIG. 10 is a cross-sectional view of the air deflector taken on line 10—10 of FIG. 6.

As can be seen in FIG. 2, a vent 4 is provided which allows cold air to flow from the evaporator compartment 15 through the partition assembly 3 into an air deflector 6 mounted on the bottom of the partition assembly 3. The air deflector 6 consists of a deflector core 9 and a deflector cover 7. The air deflector 6 routes the cold air both into the fresh food compartment 2 and directly into the meat keeper compartment 50.

The partition assembly 3 is composed of a layer of insulation 10 and a partition liner 11 which forms the top wall of the fresh food compartment 2.

The deflector core 9 is made of material which is suitable for molding and also has excellent insulation properties, such as polystyrene foam. A deflector cover 7 fits around the deflector core 9 and is provided with two front attaching flanges **8*a* and two back attaching flanges 8*b*. There are four recesses 12 in the partition assembly 3 which cooperate with the front and back attaching flanges 8*a* and 8*b*. The partition liner 11 extends part way across this recess and terminates in shoulder 13. The deflector cover 7 secures the deflector core 9 to the partition assembly 3 by means of the front and back attaching flanges 8*a* and 8*b***.

To mount the air deflector 6 to the partition assembly 3, the back side of the deflector cover 7 is inserted through the rear partition recess 12 until the back attaching flange **8*b* engages the liner shoulder 13. The front side of the deflector cover 7 is then compressed to allow insertion of the front attaching flange 8*a* into the front partition recess 12. The camming surface 8*c* permits the deflector cover 7 to be pushed upward until the front attaching flange 8*a* snaps into secure engagement with the shoulder 13**.

The cold air from the evaporator compartment 15 within the freezer compartment 1 flows through a vent 4 into the air deflector 6 and is channeled into the fresh food compartment 2 through a central channel 14 and to either side of the air deflector by a left side channel **16*a* and a right side channel 16*b***.

In FIG. 1 the meat keeper compartment 50 and duct assembly 20 are shown mounted on the right side of the refrigerator. In this position, the duct assembly receives air from the right side channel **16*b* through the right air guide 17*b*. Cold air is also directed into the fresh food compartment 2 through the left side channel 16*a* and left air guide 17*a*, and through the central channel 14. The proportion of air which flows through the duct assembly 20 into the meat keeper compartment 50 compared to the air flow into the fresh food compartment 2 is controlled by a damper 37 within the duct assembly 20**.

The duct assembly 20 includes an upper air duct 21 and a lower air duct 22 which telescope. The upper air duct 21 has an oblique upper leg 26 which cooperates with the deflector cover opening 18 and acts to guide the cold air from the air deflector 6 to the vertical upper leg 27 of the upper air duct 21.

The cold air flows along the back 30 of the refrigerator of the fresh food compartment 2 through the vertical upper leg 27 to the vertical lower leg 28 of lower duct 22. The air is routed from the vertical lower leg 28 through the oblique lower leg 29 of the lower air duct 22 into the meat keeper compartment 50.

The front, back, and side walls of the oblique upper leg 26 of the upper air duct 21 are formed by foam insulation 23. A casing 24 provides support for the front and side walls of the oblique upper leg 26 and further provides the front and side walls of the vertical upper leg 27 of the upper air duct 21. The rear wall 30 of the fresh food compartment 2 forms the back wall of the vertical upper leg 27 of the upper air duct 21.

The lower air duct 22 consists of a vertical lower leg 28 and a oblique lower leg 29. A casing 25 forms the front and side walls of the vertical lower leg 28 of the lower air duct 22. The back wall is formed from the rear wall 30 of the fresh food compartment 2. The casing extends to form all four walls of the oblique lower leg 29 of the lower air duct 22.

A web or brace 58 extends from the bottom wall 61 of the lower air duct 22 to the rear wall of the fresh food compartment 2. This provides further support as the lower air duct 22 is slid along the rear wall 30 of the fresh food compartment 2 and acts to eliminate turbulence where the bottom wall 61 meets the rear wall 30.

The lower air duct 22 fits through an opening 57 in the upper air duct 21. Since the lower air duct 22 is smaller than the upper air duct 21 it telescopes within the upper air duct 21. Thus, the lower air duct 22 can be slid to position the cold air outlet 62 as desired. The oblique lower leg 29 of the lower air duct 22 extends through an aperture 32 in the meat keeper receptacle 31. This channels the cold air directly from the evaporator compartment 15 within freezer compartment 1 through the duct assembly 20 out the cold air outlet 62 into the meat keeper compartment 50.

On one end the meat keeper cover shelf 33 has hooks 63 which are inserted into the hole 64 in the shelf support 36 in order to mount the meat keeper cover shelf 33. A bracket 34 extends from the meat keeper cover shelf 33 to the shelf support 36 and provides vertical support for the meat keeper cover shelf 33. The meat keeper receptacle 31 is mounted from the meat keeper cover shelf 33 and also acts in sliding cooperation with the meat keeper cover shelf 33 in order to allow the meat keeper receptacle 31 to be opened and closed.

A damper 37 is mounted within the upper air duct 21 at pivot 39 and can thus be adjusted to allow various amounts of air to flow into the meat keeper compartment 50. When in a position transverse to the vertical upper leg 27 of the upper air duct 21, the damper 37 extends substantially across the upper air duct 21 to inhibit the flow of air into the meat keeper compartment 50. Three detents 40, 41, and 42 are provided which cause the damper 37 to be arrested in the fully open position at detent 40, in a half open position at detent 41, and in a fully closed position at detent 42. The action of the damper 37 is controlled by a damper control handle 38.

The upper duct 21 is provided on the outside with a recess 44 for a decal 43. The decal is marked so that the position of the damper control 38 along the decal will indicate to the user the position of the damper 37.

The entire air duct assembly 20 is held in place by means of a single fastener such as air duct screw 45. The screw 45 extends through a hole in the upper air duct 21 and through a slot 59 in the lower air duct 22. It engages a nut 46 behind the rear wall 30 of the fresh food compartment 2. An air duct screw hole (not shown) is provided on either side of the rear wall 30 of the fresh food compartment 2 so that the air duct assembly 20 can be mounted by means of the air duct screw 45 on either side of the fresh food compartment 2. A plug (not shown) is inserted into the side which is not in use.

The air duct screw 45 fits into a well 52 recessed within the upper air duct 21. A detaining rib 49 extends from the back of the screw well 52. Grooves 51 are provided within the front face of the lower air duct 22. The detaining rib 49 cooperates with the grooves 51 to hold the lower air duct 22 at the desired position relative to the upper air duct 21. As the air duct screw 45 is loosened, the detaining rib 49 disengages the grooves 51. This allows the user to raise or lower the cold air outlet 62 of the lower air duct 22 to the desired position and then to secure the lower air duct into position by tightening the air duct screw 45 and re-engaging the detaining rib 49 in a new groove 51.

As can be seen in FIGS. 4 through 10, a gasket 48 is provided for the air deflector 6 to provide an airtight seal between the air deflector 6 and the partition assembly 3. Air channeled through the vent 4 flows through the central channel 14 into the fresh food compartment 2 and through the two side channels **16*a* and 16*b* into either the air duct assembly 20 or the rear of the fresh food compartment 2**.

If the user closes the damper 37 within the duct assembly 20, the direct flow of cold air through the duct assembly 20 into the meat keeper compartment 50 is inhibited and instead the cold air is channeled directly into the fresh food compartment 2 through the central channel 14 and through the remaining open side channel 16 and air guide 17.

Vertical positioning of the meat keeper compartment 50 and duct assembly 20 is accomplished as follows: The user first removes the meat keeper receptacle 31 from the meat keeper cover shelf 33. The user then disengages the meat keeper cover shelf 33 from the shelf support 36 by raising the cover shelf 33 until the shelf hooks 63 are aligned with the shelf support holes 64, and then drawing the cover shelf 33 toward him, he removes the cover shelf 33 from the refrigerator.

The cold air outlet 62 at the end of the lower air duct 22 is then adjusted so that the cold air outlet 62 will deliver cold air through the aperture 32 in the back of the meat keeper receptacle 31 after it has been raised or lowered. To this end, the lower air duct 22 is raised or lowered by loosening the air duct screw 45 so that the detaining rib 49 no longer engages the groove 51, sliding the lower air duct 22 into position, and tightening the air duct screw 45 so that the detaining rib engages a new groove 51.

The cover shelf 33 is put into place by engaging the shelf hooks 63 with new shelf support holes 64 so that the cover shelf 33 will rest at the desired height. Finally the meat keeper compartment 31 is once again mounted on the meat keeper cover shelf 33.

The repositioning of the meat keeper compartment 31 and duct assembly 20 to the other side of the fresh food compartment 2 is accomplished as follows: The user first removes the meat keeper receptacle 31 from the meat keeper cover shelf 33 and then removes the meat keeper cover shelf 33 by disengaging it from the shelf support 36 as discussed above.

The duct assembly 20 is subsequently switched to the other side in the following manner. The plug (not shown) is removed from the side where the duct assembly 20 is to be placed. The air duct screw 45 is removed. The upper air duct 21 is disengaged from the air deflector cover opening 18. The air duct assembly 20 is switched to the other side of the fresh food compartment 2. The lower air duct 22 is positioned at the desired location and the air duct screw 45 is inserted into the hole 47 and tightened so that the detaining rib 49 engages the groove 51. The meat keeper cover shelf 33 is positioned in the proper holes 64 of the shelf support 36. Finally, the meat keeper receptacle 31 is re-mounted on the meat keeper cover shelf 33.

Although the invention has been described in the form of a particular embodiment, being the best mode of carrying out the invention, and detailed descriptive language has been used, it is not so limited. Instead, the following claims are to be read encompassing all modifications and adaptations of the invention falling within the scope and spirit thereof.

What is claimed is:

1. A meat keeper compartment in a refrigerator having a freezer compartment and a separate fresh food compartment comprising:

a meat keeper receptacle;

means for mounting the meat keeper receptacle at different laterally spaced positions within the fresh food compartment;

a duct in said fresh food compartment channelling cold air from the freezer compartment into the meat keeper receptacle; and means to mount said air duct at different laterally spaced positions in said fresh food compartment corresponding to said different lateral positions of the meat keeper receptacle.

2. A meat keeper compartment as set forth in claim 1, wherein the duct includes adjustable damper means to regulate the flow of air from the freezer compartment to the storage container.

3. A meat keeper compartment as set forth in claim 1, wherein the meat keeper receptacle occupies about one half the width of the fresh food compartment and said different laterally spaced positions are on either side of the fresh food compartment.

4. A meat keeper compartment as set forth in claim 3, wherein the means for mounting the meat keeper receptacle comprises a cantilevered shelf which can be positioned at different vertical levels and at different sides within the fresh food compartment and which forms the cover for the meat keeper receptacle.

5. A meat keeper compartment as set forth in claim 1, wherein the air flow assembly comprises an air deflector, an upper air duct and a lower air duct, in which the air deflector directs air from the freezer compartment into the upper air duct, the upper air duct directs air into the lower air duct, and the lower air duct directs air through an aperture in the meat keeper receptacle; and where the lower air duct cooperates with the upper air duct in a telescoping manner.

6. A meat keeper compartment as set forth in claim 4, wherein the air deflector has a central air channel which directs air from the freezer into the fresh food compartment and has side channels whereby air is directed through one side channel into the meat keeper receptacle and through another side channel into the fresh food compartment.

7. A meat keeper compartment as set forth in claim 4, wherein the back wall of the refrigerator forms at least a portion of the back walls of the upper air duct and the lower air duct.

8. A meat keeper compartment as set forth in claim 1, wherein the duct is secured within the fresh food compartment by a single fastener.

9. In a refrigerator having a top freezer compartment separated by a partition from the fresh food compartment, a meat keeper compartment comprising:

a meat keeper receptacle of about half the width of the fresh food compartment;

a vertically positionable shelf whereby the meat keeper receptacle is mounted from the shelf, the shelf forming the cover of the meat keeper compartment and the meat keeper compartment being mountable on either side of the fresh food compartment;

an air deflector which is mounted to the partition which receives cold air from the freezer through an aperture in the partition, the air deflector having a central channel and two side channels;

an upper air duct which cooperates with the air deflector and can be mounted from either side of the air deflector and receives air from one of the side channels;

a lower air duct which telescopes into the upper air duct; and an adjustable damper means to regulate the flow of air from the freezer compartment to the storage container.

10. A meat keeper compartment as set forth in claim 9, wherein the back wall of the refrigerator forms at least a portion of the back walls of the upper air duct and the lower air duct.

11. A meat keeper compartment as set forth in claim 9, wherein the duct is secured in position by a single fastener.

12. A meat keeper compartment as set forth in claim 9, wherein the lower air duct is retained in a position relative to the upper air duct by a detaining rib.

* * * * *